United States Patent [19]

Kitt et al.

[11] 4,451,014

[45] May 29, 1984

[54] WIRE STORING AND DEREELING APPARATUS

[75] Inventors: Robert A. Kitt, Albion; Harold L. Wirts, Garrett, both of Ind.

[73] Assignee: Mossberg Industries, Inc., Garrett, Ind.

[21] Appl. No.: 407,146

[22] Filed: Aug. 11, 1982

[51] Int. Cl.[3] ..... B65H 49/00

[52] U.S. Cl. ..... 242/128; 242/129.6

[58] Field of Search ..... 242/128, 129.5, 129.6, 242/130, 137, 137.1; 206/389, 391, 392, 394, 407, 409; 220/200

[56] References Cited

U.S. PATENT DOCUMENTS 2,044,207 6/1936 Chaffin ..... 242/137.1

3,355,061 11/1967 Ritter ..... 206/389 X

*Primary Examiner*—Leonard D. Christian

*Attorney, Agent, or Firm*—George A. Gust

[57] ABSTRACT

An apparatus having the dual capability both as a transporting and storage apparatus and a dereeling apparatus for wire wound on a spool. The apparatus comprises a container having an annular rib on its lower inner surface which engages a groove disposed in the bottom flange of the spool received therein to secure the spool against radial and axial movement during normal use. The cover for the container is movable between a closed position and a dereeling position wherein the cover top surface is disposed above the spool upper flange a predetermined distance. The cover has upper and lower detents for removably securing it in its closed and dereeling positions, respectively, on the container. The container bottom has a hole therein and the cover has a locating boss disposed on its top surface in axial alignment with the bottom hole so that the locating boss is receivable within the arbor-receiving hole of a spool in a like apparatus stacked thereon. The locating boss serves to guide the arbor-receiving hole thereon and to maintain the apparatuses in stacked storage. A guide member is removably inserted within the locating boss and has an aperture therein through which the wire wound on the spool is dereeled. The guide member is preferably made of a plastic member to reduce any wear on the wire when it is dereeled. As described, the apparatus of the present invention is reusable for transporting, storing and dereeling other wire-wound spools.

11 Claims, 7 Drawing Figures

WIRE STORING AND DEREELING APPARATUS

BACKGROUND OF THE INVENTION

1. Field of the Invention

The present invention relates to an apparatus for unreeling wire from a wire-carrying spool and which also serves as an apparatus for storing the wire-carrying spool.

2. Description of the Prior Art

Dereeling apparatuses conventionally employ funnel-shaped shrouds disposed in an inverted position over a pail or the like in which is mounted a spool having helically wound wire thereon. The wire is then axially drawn off the spool through the funnel at high speed. The wire wound spools are generally transported and stored in a separate container within the warehouse, and when a particular type of wire is required, the stored wire-wound spool is removed from its storage container and then placed within the pail and the funnel-shaped shroud attached thereover. Since the shrouds serve only a general purpose in the dereeling operation, they are attached to the pail in a simple manner such as by adhesive tape or the like. When the wire is completely drawn off the spool, the adhesive tape and shroud are removed and the spool is withdrawn from the pail.

Several disadvantages exist in the above prior art dereeling apparatuses, a primary one being the lack of a single container capable of serving both as a transporting and storing apparatus, and a dereeling apparatus. This means that two types of containers must be maintained on hand in the warehouse or the building where the dereeling is performed, one of the containers being for storage and the other for dereeling, thereby taking up additional space within the warehouse or building and adding unnecessarily to equipment costs.

In most cases the prior art dereeling apparatuses are not adapted to be stacked one upon the other for storage, and those that are able to be stacked generally require a special frame or device which permits stacking thereof. In the latter case, an additional piece of equipment is again required to be purchased and stored within the warehouse or building.

Another disadvantage with dereeling apparatuses in current use is the general lack of means of attaching the funnel-shaped shroud to the apparatus other than by adhesive tape or the like. This procedure is not only time-consuming in that it requires a worker to continually tape and untape during the dereeling operations, but is also costly in terms of expended man-hours and materials.

SUMMARY OF THE INVENTION

In contrast to the above apparatuses, the present invention generally provides an apparatus which serves as both a transporting and storage apparatus and a dereeling apparatus. The spool being transported, stored, and dereeled is preferably disposed with its axis generally vertically inclined. Regarding the transporting and storage capability of the apparatus of the present invention, a container is provided having an open top, a bottom, and an annular rib circumferentially disposed on the inner surface of the container in close proximity to the bottom and extending radially inwardly therefrom. The wire-wound spool is then placed within the container so that the annular rib is engaged by a groove circumferentially disposed in the bottom flange of the spool, thereby securing the spool against movement within the container. A cover is provided for the container, which cover also assists in securing the spool within the container, and is attached thereto in the following manner. The periphery of the container top is shaped as a lip or flange radially outwardly disposed from the container side. The cover is shaped to close the open top of the container and has two diametrically opposed handles extending axially downwardly therefrom relative to the container bottom. Each handle has on its inner radial surface a pair of detents, one being adjacent the cover top and the other being disposed on the more remote distal end of the handle. When the cover is placed on the container and pressed downwardly thereover, the lower detent of each handle is engaged by the container flange, and, upon further downward movement, the lower detents are disengaged and the upper detents engaged by the container flange, thereby securing the cover over the container in a closed position. Preferably, in the closed position, the cover abuts against the spool upper flange.

As described, the spool and container are ready for transportation and storage. Stacking of the spool and container assembly is accomplished by providing a hole or opening in the bottom of the container, the opening naturally having a maximum width less than the maximum width of the spool bottom flange, and a protuberance or locating boss centrally positioned on the cover in axial alignment with the bottom hole and extending axially outwardly therefrom relative to the container bottom. The remote distal surface portion of the locating boss is slopingly, radially inclined to assist in locating and guiding thereon the arbor-receiving opening of a spool in a second container being stacked thereon. This permits the stacking of the containers containing spools to be easily and uniformly accomplished without need of further devices or aids.

As to the dereeling capability of the apparatus of the present invention, a removable guide bushing is inserted in the locating boss and has an aperture axially disposed therethrough to receive a strand of wire from the spool. In preparation for dereeling the strand of wire, the handles on the cover are grasped, the handles being radially spaced apart from the container side, and resiliently moved radially outwardly to disengage the upper detents from the container flange, and the cover is then moved upwardly to allow the lower detents to engage the flange. In this position, the cover and the locating boss in which the guide bushing is inserted are displaced axially upwardly above the spool a predetermined distance for optimal payoff of the strand of wire. By use of the lower detents to maintain the guide bushing at the proper distance above the spool, the requirement of taping and untaping a shroud is eliminated. Furthermore, the guide bushing is preferably made of a plastic material to reduce any wear on the wire as it is payed therethrough.

As may now be seen from the above description, the apparatus of the present invention provides both capabilities for transporting and storing, and dereeling wire wound upon the spool. By doing so, additional equipment requirements are eliminated, man-hours reduced, and materials eliminated, thereby resulting in a more simple and economical spool storing and dereeling operation. Further, once the spool has been unwound of the wire, it may be removed and the container reused as just described.

It is an object of this invention to provide an apparatus capable of serving both as a transporting and storing apparatus and a dereeling apparatus.

It is another object of this invention to provide an apparatus for transporting and storing and dereeling which may be stacked with other like apparatuses.

Yet another object of this invention is to provide with the dereeling aspect thereof a cover securable in a closed position and in a dereeling position without use of adhesive materials.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1:
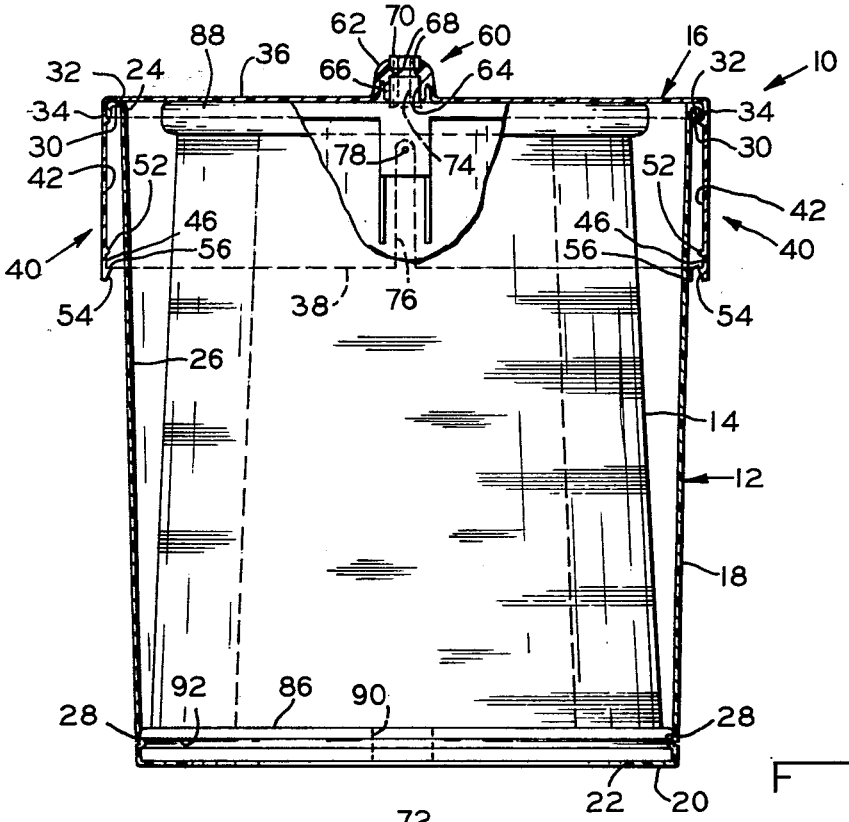
FIG. 1 is a sectional view through the axis of one embodiment of this invention with the cover in the closed position.

Referring to the drawings, wire storing and dereeling apparatus 10 of the present invention generally comprises container 12 adapted to hold a cylindrical wire-retaining device or spool 14 and cover 16 received thereover. Container 12 comprises a continuous side wall 18 of generally cylindrical shape, a bottom 20 having a hole 22 disposed therein, and an open top 24. Bottom 20 may be integral to side wall 18 or may be joined thereto in any suitably conventional manner. Located on inner surface 26 of side wall 18 and spaced above bottom 20 is annular rib 28 extending radially inwardly therefrom. Annular rib 28 is preferably integrally molded with side wall 18. In place of annular rib 28, a series of spaced-apart rib members or rounded projections could be substituted therefor. However, annular rib 28 is preferred for the purpose for which it is provided.

Figure 2:
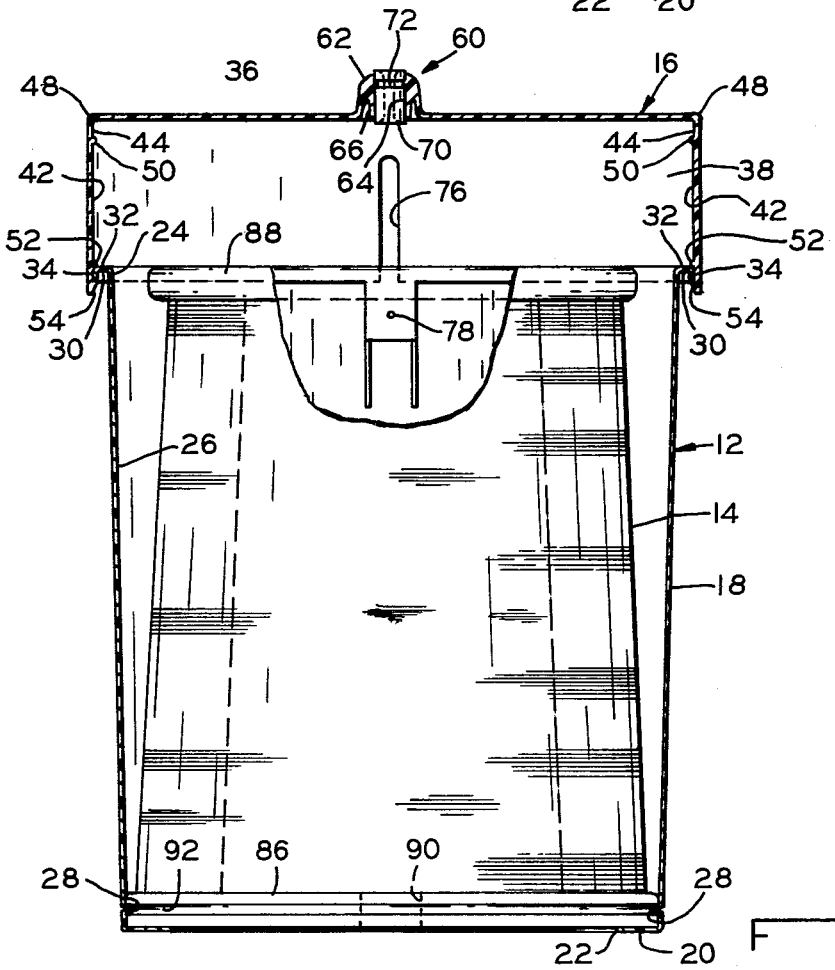
FIG. 2 is similar to FIG. 1 with the cover in the dereeling position.

Referring more particularly to FIGS. 1 and 2, the periphery of open top 24 of container 12 is shaped as an annular flange 30 comprising a generally horizontally disposed annular extension 32 extending radially outwardly from open top 24 and a generally vertically disposed annular lip 34 extending axially downwardly from annular extension 32. Annular flange 30 acts as the locking mechanism for cover 16 and as a reinforcing element for open top 24 of container 12.

Figure 3:
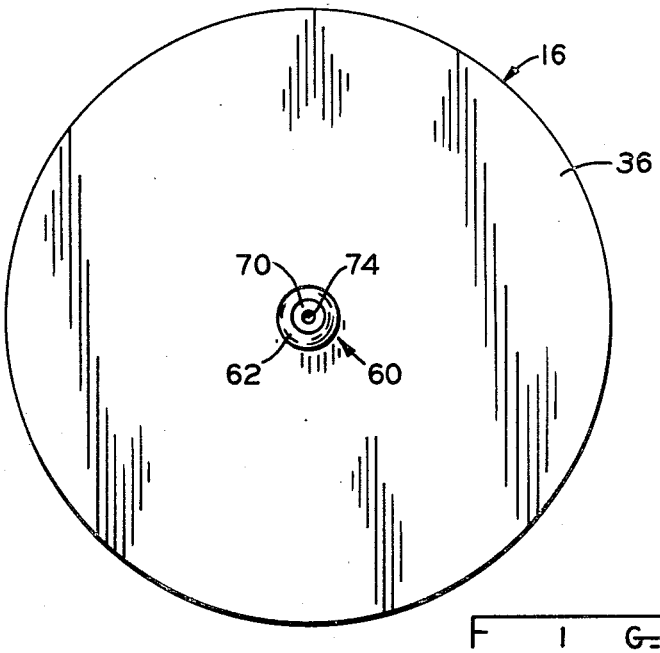
FIG. 3 is a top plan view of the cover.

Referring now to FIGS. 1, 2 and 3, cover 16 is seen to comprise top surface 36 and a skirt or collar 38 extending downwardly from the periphery of top surface 36. Top surface 36 is constructed such that upon the placement of cover 16 over open top 24 the area of joinder of top surface 36 and collar 38 snugly fits against flange 30. Since lip 34 of flange 30 is radially spaced apart from side wall 18, so also is cover flange or collar 38 when cover 16 is placed over open top 24.

Figure 4:
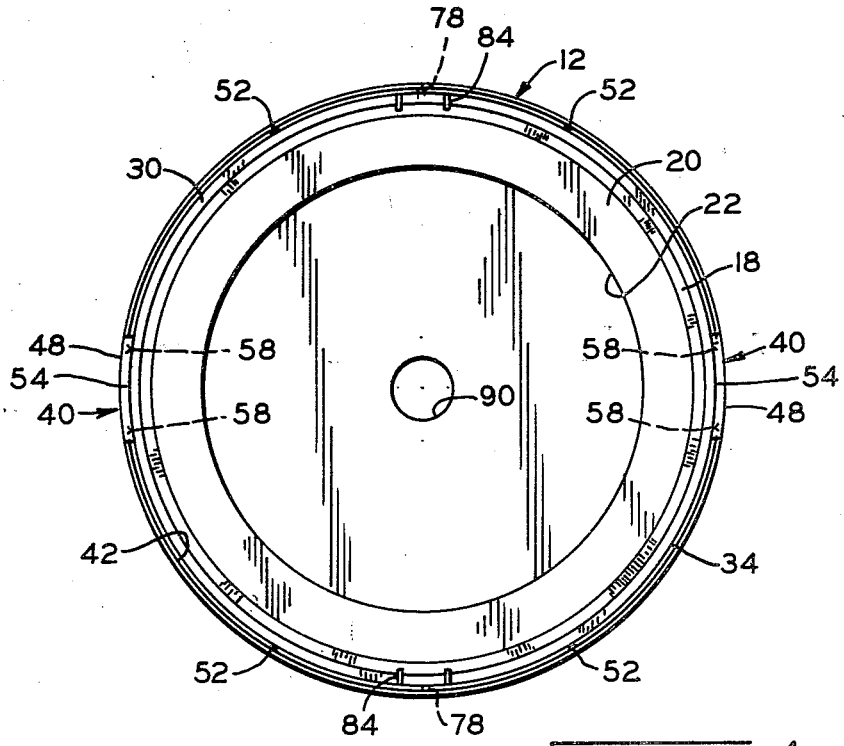
FIG. 4 is a bottom plan view of the embodiment.

Referring now particularly to FIGS. 1, 2 and 4, collar 38 has two diametrically opposed resilient detent extensions 40 formed therein. Each extension 40 has an inner surface 42 on which is disposed an upper detent 44 (FIG. 2) and a lower detent 46 (FIG. 1). Viewing FIGS. 1 and 2, upper detent 44 comprises joinder 48 of collar 38 and top surface 36 and circumferential rib member 50. Rib member 50 is located at a predetermined point on inner surface 42 relative to joinder 48. Lower detent 46 also comprises an elongated rib member 52 similar to rib member 50 and an enlongated end 54 enlarged in cross-section. Enlarged end 54 has a generally horizontally disposed support surface 56 extending radially inwardly from inner surface 42 of extension 40. Rib member 52 and support surface 56 are separated a predetermined distance comparable to the distance between rib member 50 and joinder 48. Both rib members 50, 52 may be replaced by small rounded projections or bosses 58 (FIG. 4), the projections 58 being in circumferential alignment one with the other.

Centrally disposed on top surface 36 of cover 16 is locating boss 60 extending axially outwardly therefrom relative to container bottom 20 and which has an outer surface 62 sloping radially inwardly to hole 64 formed by inner bushing 66 of locating boss 60. Circumferentially disposed along the inner surface of inner bushing 66 is annular rib 68 (FIG. 1); locating boss 60, inner bushing 66, and annular rib 68 are preferably integrally molded to cover 16. A guide bushing 70, preferably made of a plastic material, is removably inserted in hole 64 and secured therein by annular rib 68 being received within groove 72 (FIG. 2) of guide bushing 70. Guide bushing 70 also has an axial bore 74 axially disposed therein for receiving a strand of wire therethrough during the dereeling operation. Guide bushing 70 is easily installed and replaced manually by the operator.

Figure 5:
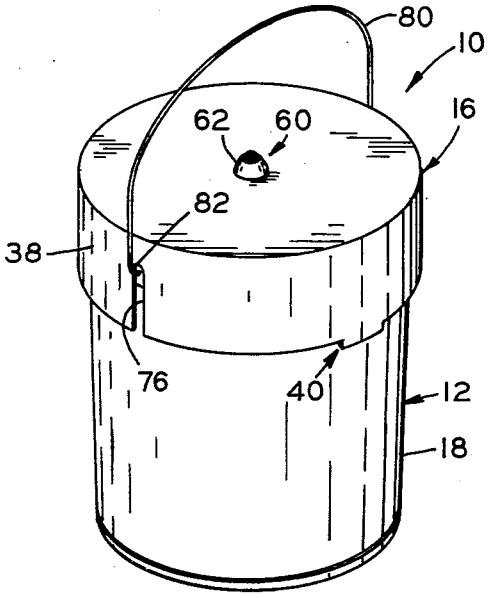
FIG. 5 is a perspective of the embodiment with the cover in the closed position and a bale attached to the container.

Referring to FIGS. 1, 4 and 5, collar 38 has a slot 76 disposed therein and container 12 has an opening 78 disposed therein. When cover 16 is closed over open top 24, and opening 78 and slot 76 are aligned, bail 80 may be attached thereto by placing a respective end 82 of bail 80 within a respective opening 78. Reinforcement of container 12 during the transporting of apparatus 10 by means of bail 80 is provided by bracket 84 through which opening 78 is also disposed.

Figure 7:
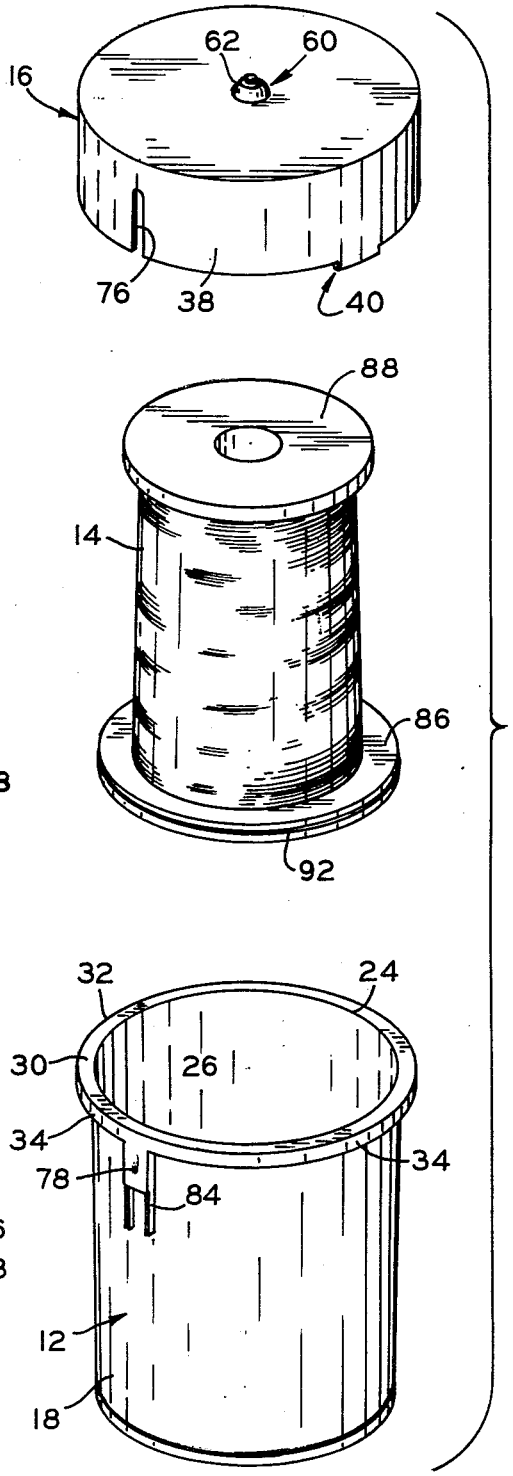
FIG. 7 is an exploded view of the embodiment with a spool.

Use of apparatus 10 will be explained by reference to the figures, and, beginning with FIG. 7, spool 14 having spool bottom flange 86 and top flange 88, and which is wound with a conventional wire, is placed within container 12 so that groove 92 in bottom flange 86 is engaged by annular rib 28 on inner surface 26. This engagement secures spool 14 against axial and radial movement within container 12 during its normal and intended use. Cover 16 is then placed over open top 24 and pushed downwardly thereon so that lower detent 46 is engaged and then disengaged with flange 30 and upper detent 44 engaged thereto when lip 34 nests between rib member 50 and joinder 48 of upper detent 44 (FIGS. 1, 2). In this closed position, cover 16 abuts against spool top flange 88 to further secure spool 14 within container 12, and, if slots 76 are aligned with respective openings 78, bail 80 may be attached to container 12 to permit a user to transport container 12.

Figure 6:
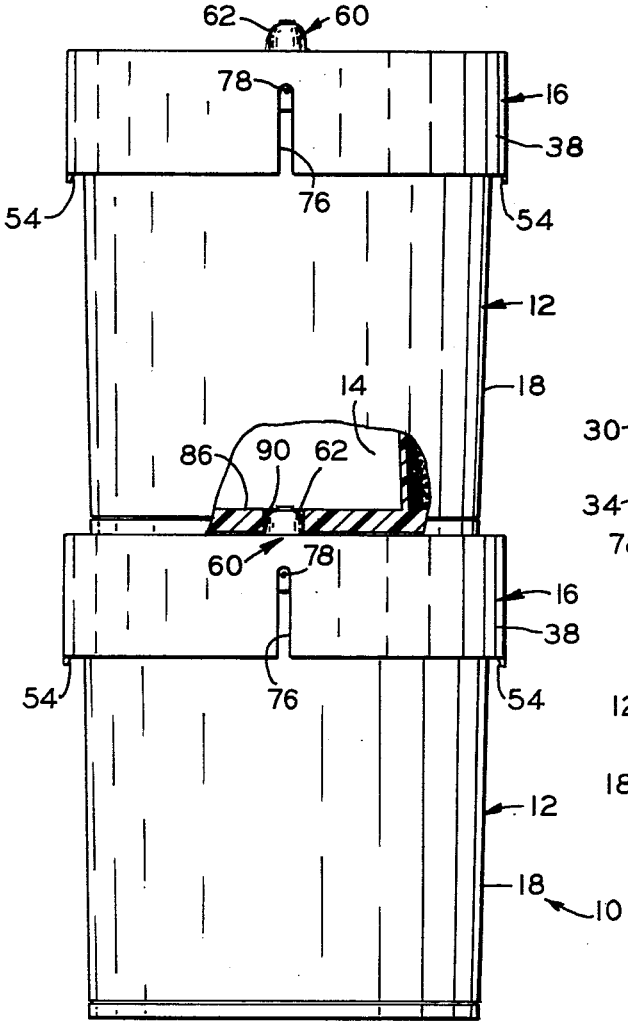
FIG. 6 illustrates two such containers stacked together.

If it is desirable to stack several such apparatuses 10 (FIG. 6), this may be easily, manually accomplished by placing a first apparatus 10 on top of a second apparatus 10 so that arbor-receiving hole 90 of spool 14 in the top apparatus 10 is received over locating boss 60 of the bottom apparatus 10. Because the locating boss 60 has sloping outer surface 62, it assists the user in locating and guiding arbor-receiving hole 90 over and onto locating boss 60. Thereafter, bail 80 may be removed and used with other such apparatuses 10. Alternatively, the bottom of the bucket 12 may be made solid with a central dome which fits upwardly into hole 90. The boss 60 then fits into the hollow underside of the dome.

Apparatus 10 in addition to providing a transporting and storage capability for a spool 14, also serves as a dereeling apparatus. In this particular mode of operation, apparatus 10 may be manually transported to the dereeling area, and positioned in its dereeling position by the operator grasping each extension 40, as he might a handle, and moving them outwardly to disengage upper detent 44 and upwardly so as to engage lower detent 46 with flange 30. Flange 30 is engaged with lower detent 46 when lip 34 is received between support surface 56 and rib member 52. In this position (FIG. 2) top surface 36 is disposed a predetermined distance above top flange 88. When cover 16 is in its dereeling position, the bottom periphery of collar 38 is positioned no higher than open top 24 to prevent the strands of wire being unreeled from being thrown radially outwardly beyond container sidewall 18.

If not already installed, a plastic guide bushing 70 is inserted within hole 64 of locating boss 60 and a strand of the wire on spool 14 is then received through aperture 74 of guide bushing 70. The strand of wire is then fed to a conventional idler wheel (not shown) and secured to the dereeling mechanism (not shown) for dereeling from spool 14. Since guide bushing 70 is preferably made of a plastic material, undesirable wear on the wire being payed therethrough is reduced. Since guide bushing 70 is easily installed and removed manually, it may be quickly replaced should it become worn from multiple dereeling operations.

When the strand of wire has been completely dereeled from spool 14, apparatus 10 may be reused by simply removing cover 16, removing spool 14, and either rewinding wire on spool 14 or replacing a new wire-wound spool 14 within container 12 and then placing cover 16 over open top 24 in the closed position.

Apparatus 10 is preferably made of a plastic material, however, certain parts thereof may be made of other materials that are equally lightweight and durable.

The dual capability of apparatus 10 both as a transporting and storing apparatus and a dereeling apparatus may now be fully appreciated in contrast to the prior art apparatuses wherein two different apparatuses were required for the transporting and storage mode and dereeling mode. Apparatus 10 of the present invention therefore eliminates the need of extra pieces of equipment in the warehouse, thereby eliminating excessive use of additional space and reducing material costs. Further, since apparatus 10 has this dual capability, a reduction of man-hours in the dereeling operation is realized since the operator need not transfer spool 14 from a storage container to a separate dereeling container, and since cover 16 is removably secured in the dereeling position by lower detent 46 and flange 30, use of adhesive materials and the man-hours required to apply them to secure cover 16 in the dereeling position is likewise eliminated to further reduce costs.

Also, since attrition of the wire during pay-out can unduly wear the bore 74, it is a simple matter merely to replace guide bushing 70, thereby essentially retaining intact the entire pail structure, in like-new condition, for reuse.

While there have been described above the principles of this invention in connection with specific apparatus, it is to be clearly understood that this description is made only by way of example and not as a limitation to the scope of the invention.

What is claimed is:

1. Apparatus for storing and dereeling wire on a spool disposed with the axis thereof upright, comprising:

a container having an open top and a bottom, and adapted to receive said spool therein, said container including rib means disposed on the inner surface thereof in close proximity to said container bottom, said rib means extending radially inwardly and adapted to be engaged by a groove in a bottom portion of said spool to thereby secure said spool in said container, a cover being receivable over said open top of said container, said cover being movable on said container between a closed position and a dereeling position wherein a midportion of said cover is spaced above said spool a predetermined distance, locking means on one of said container and said cover, means on the other of said container and said cover for engaging said locking means to removably secure said cover in said closed position and alternately to removably secure said cover in said dereeling position, and means centrally disposed of said container axially above said spool for receiving a strand of wire being unreeled from said spool.

2. The apparatus of claim 1 wherein said receiving means includes a removable guide member inserted in said midportion of said cover, said guide member having an aperture therein adapted to receive the strand of wire being unreeled from said spool.

3. The apparatus of claim 2 wherein said guide member is made of a plastic material.

4. Apparatus for storing and dereeling wire on a spool disposed with the axis thereof upright, comprising:

a container having an open top and a bottom having an arbor receiving recess therein, the container adapted to receive said spool therein, a cover being receivable over said open top of said container, said cover being movable on said container between a closed position and a dereeling position wherein a midportion of said cover is spaced above said spool a predetermined distance, locking means on one of said container and said cover, means on the other of said container and said cover for engaging said locking means to removably secure said cover in said dereeling position, means centrally disposed of said container axially above said spool for receiving a strand of wire being unreeled from said spool, and a boss member disposed on the outer surface of said cover midportion in axial alignment with said recess in said bottom and extending axially outwardly from the outer surface, said boss member being adapted to be received in the arbor-receiving recess of a spool in a like apparatus stacked thereon.

5. The apparatus of claim 4 wherein said receiving means includes a removable guide member inserted in said boss member, said guide member having an aperture axially disposed therein adapted to receive the strand of wire being unreeled.

6. The apparatus of claim 5 wherein said container includes rib means disposed on the inner surface thereof in close proximity to said container bottom, said rib means extending radially inwardly and adapted to be removably engaged by a groove in a bottom portion of said spool, thereby securing said spool in said container.

7. The apparatus of claim 6 wherein said rib means is an annular rib.

8. The apparatus of claim 7 wherein said guide member is made of a plastic material.

9. Apparatus for storing and dereeling wire on a spool disposed with the axis thereof upright, comprising:

a container having an open top and a bottom, and adapted to receive said spool therein, a cover being receivable over said open top of said container, said cover being movable on said container between a closed position and a dereeling position wherein a midportion of said cover is spaced above said spool a predetermined distance, locking means in the form of an annular flange on one of said container and said cover, means on the other of said container and said cover for engaging said locking means to removably secure said cover in said closed position and alternately to removably secure said cover in said dereeling position comprising diametrically opposed pairs of detent means for engaging the locking means whereby a user may grasp the cover near the diametrically opposed detent means and deform the cover to disengage the respective pair of detent means for moving the cover to a different position, and means centrally disposed of said container axially above said spool for receiving a strand of wire being unreeled from said spool.

10. The apparatus of claim 9 wherein said locking means is disposed on said container and said engaging means is disposed on said cover.

11. The apparatus of claim 10 wherein said locking means includes a flange member radially outwardly disposed along the periphery of said container top, and wherein said engaging means includes two oppositely disposed resilient extension members joined to the periphery of said cover and extending axially downwardly therefrom and in radial spaced relation relative to said container, each said extension member having on its inner surface an upper detent means and a lower detent means, said upper and lower detent means being separately engageable with said flange member, whereby said cover is secured in said closed position when said upper detent means engage said flange member, and, upon said extension members being moved radially outwardly to disengage said upper detent means and said cover moved upwardly, secured in said dereeling position when said lower detent means engage said flange member.

* * * * *